US010301989B2

(12) United States Patent
Imada

(10) Patent No.: US 10,301,989 B2
(45) Date of Patent: May 28, 2019

(54) MICROWAVE APPLICATOR, EXHAUST GAS PURIFIER, HEATER, AND CHEMICAL REACTOR

(71) Applicant: FUJITSU LIMITED, Kawasaki-shi, Kanagawa (JP)

(72) Inventor: Tadahiro Imada, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 85 days.

(21) Appl. No.: 15/364,224

(22) Filed: Nov. 29, 2016

(65) Prior Publication Data

US 2017/0204757 A1 Jul. 20, 2017

(30) Foreign Application Priority Data

Jan. 19, 2016 (JP) ..... 2016-007943

(51) Int. Cl.

| | |
|---|---|
| ***H05B 6/64*** | (2006.01) |
| ***H05B 6/68*** | (2006.01) |
| ***H05B 6/70*** | (2006.01) |
| ***H05B 6/80*** | (2006.01) |
| ***F01N 3/028*** | (2006.01) |

(52) U.S. Cl.

CPC ..... *F01N 3/028* (2013.01); *H05B 6/6447* (2013.01); *H05B 6/686* (2013.01); *H05B 6/70* (2013.01); *H05B 6/701* (2013.01); *H05B 6/80* (2013.01)

(58) Field of Classification Search

USPC ..... 60/274, 275, 295, 297, 300, 303

See application file for complete search history.

(56) References Cited

U.S. PATENT DOCUMENTS

| | | | | |
|---|---|---|---|---|
| 4,934,141 | A * | 6/1990 | Ollivon | B01D 49/00 60/275 |
| 7,138,615 | B1 * | 11/2006 | Williamson | B01D 46/0063 219/679 |
| 7,303,603 | B2 * | 12/2007 | Gregoire | B01D 46/0063 55/282.2 |
| 7,475,533 | B2 * | 1/2009 | Hirata | B01D 53/9431 60/275 |
| 7,931,727 | B2 * | 4/2011 | Gonze | F01N 3/028 55/282.3 |

(Continued)

FOREIGN PATENT DOCUMENTS

| | | |
|---|---|---|
| JP | H04-119817 | 6/1992 |
| JP | 2002-070530 | 3/2002 |

(Continued)

*Primary Examiner* — Binh Q Tran

(74) *Attorney, Agent, or Firm* — Fujitsu Patent Center

(57) ABSTRACT

A microwave applicator includes a housing configured to contain an object of heating, multiple microwave resonators provided on and around a periphery of the housing, a microwave conductor interconnecting the microwave resonators, and a microwave generator configured to generate microwaves of different frequencies. Each microwave resonator is configured to resonate the generated microwaves of a resonant frequency of the microwave resonator, and to emit the resonated microwaves to the object of heating contained in the housing. Among the microwave resonators, a first microwave resonator and a second microwave resonator have respective resonant frequencies that are different from each other.

10 Claims, 10 Drawing Sheets

(56) References Cited

U.S. PATENT DOCUMENTS

| | | | | |
|---|---|---|---|---|
| 2011/0017706 | A1* | 1/2011 | Takahashi | H01J 37/32192 216/69 |
| 2011/0108548 | A1* | 5/2011 | Nobue | H05B 6/6402 219/702 |
| 2012/0103975 | A1 | 5/2012 | Okajima | |

FOREIGN PATENT DOCUMENTS

| | | |
|---|---|---|
| JP | 2006-140063 | 6/2006 |
| JP | 4995351 | 8/2012 |
| WO | 2011/070721 | 6/2011 |

* cited by examiner

MICROWAVE APPLICATOR, EXHAUST GAS PURIFIER, HEATER, AND CHEMICAL REACTOR

CROSS-REFERENCE TO RELATED APPLICATION

This application is based upon and claims the benefit of priority of the prior Japanese Patent Application No. 2016-007943, filed on Jan. 19, 2016, the entire contents of which are incorporated herein by reference.

FIELD

A certain aspect of the embodiments discussed herein is related to microwave applicators, exhaust gas purifiers, heaters, and chemical reactors.

BACKGROUND

Currently, exhaust gas purifiers that employ a diesel particulate filter (DPF) as a device to remove particulates contained in exhaust gas, such as particulate matter (PM), are put to practical use. During use of such exhaust gas purifiers, particulates such as PM deposit in the DPF, and accordingly, regeneration of the DPF is required. As methods of regenerating the DPF, for example, Japanese Laid-open Patent Publication Nos. 2006-140063 and 4-179817 and Japanese Patent No. 4995351 propose methods that employ high-frequency electromagnetic waves, such as microwaves, radiated from a microwave applicator. According to such methods, the DPF is exposed to electromagnetic waves such as microwaves to heat and burn particulates such as PM deposited on the DPF, so that the DPF is regenerated.

Microwave applicators are also employed in food warmers that heat food, chemical reactors, etc. Further reference may be made to Japanese Patent No. 2689722 and Japanese Laid-open Patent Publication No. 2002-70530 for related art.

SUMMARY

According to an aspect of the embodiments, a microwave applicator includes a housing configured to contain an object of heating, multiple microwave resonators provided on and around a periphery of the housing, a microwave conductor interconnecting the microwave resonators, and a microwave generator configured to generate microwaves of different frequencies. Each microwave resonator is configured to resonate the generated microwaves of a resonant frequency of the microwave resonator, and to emit the resonated microwaves to the object of heating contained in the housing. Among the microwave resonators, a first microwave resonator and a second microwave resonator have respective resonant frequencies that are different from each other.

The object and advantages of the embodiments will be realized and attained by means of the elements and combinations particularly pointed out in the claims.

It is to be understood that both the foregoing general description and the following detailed description are exemplary and explanatory and not restrictive of the invention.

DESCRIPTION OF EMBODIMENTS

Figure 1A:
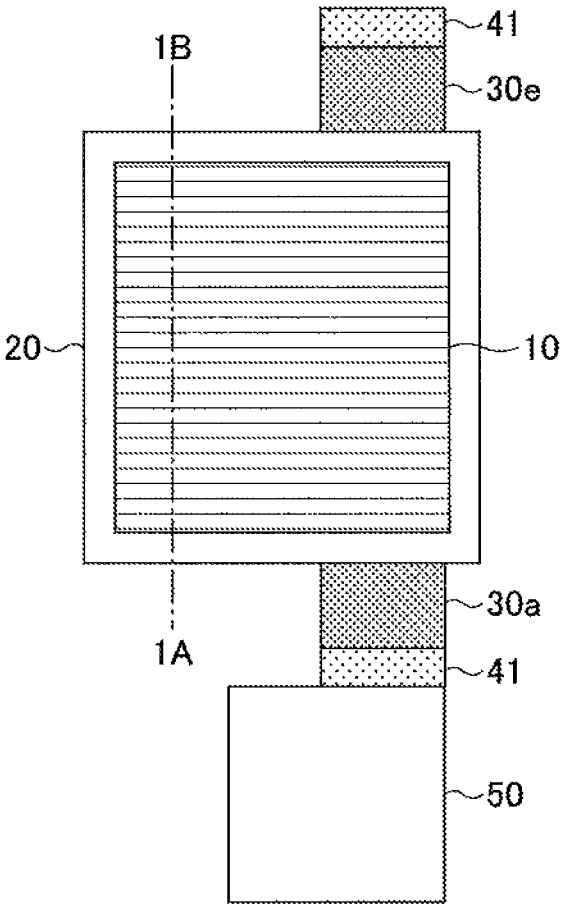
FIGS. 1A and 1B are diagrams depicting a structure of a microwave applicator according to a first embodiment.

According to the above-described exhaust gas purifiers, the DPF is regenerated by being exposed to electromagnetic waves such as microwaves to cause particulates such as PM to be subjected to dielectric heating to be oxidatively decomposed. It is difficult, however, to make the intensity of emitted microwaves uniform in the DPF, thus causing an uneven intensity distribution of microwaves to cause temperature differences in the DPF. Therefore, the amount of removal of particulates such as PM may differ between regions in the DPF, thus resulting in incomplete regeneration of the DPF.

In an attempt to make the intensity of emitted microwaves uniform, emission of microwaves that are different in phase from two antennas is proposed. According to this technique, however, because the emitted microwaves are weak in an area near the antennas within a distance of less than or equal to the half of the wavelength of the microwaves, an object of heating is less likely to be heated in this area where the intensity of microwaves is low. As a result, the object of heating is not uniformly heated. Thus, an uneven intensity distribution of microwaves is caused when the microwaves are emitted. The same is the case with food warmers or chemical reactors.

Therefore, there is a demand for a microwave applicator that is less likely to cause an uneven intensity distribution of emitted microwaves to be able to uniformly heat an object of heating.

Preferred embodiments of the present invention will be explained below with reference to accompanying drawings. The same member is referred to using the same reference numeral, and a repetitive description thereof is omitted.

[a]First Embodiment

Figure 1B:
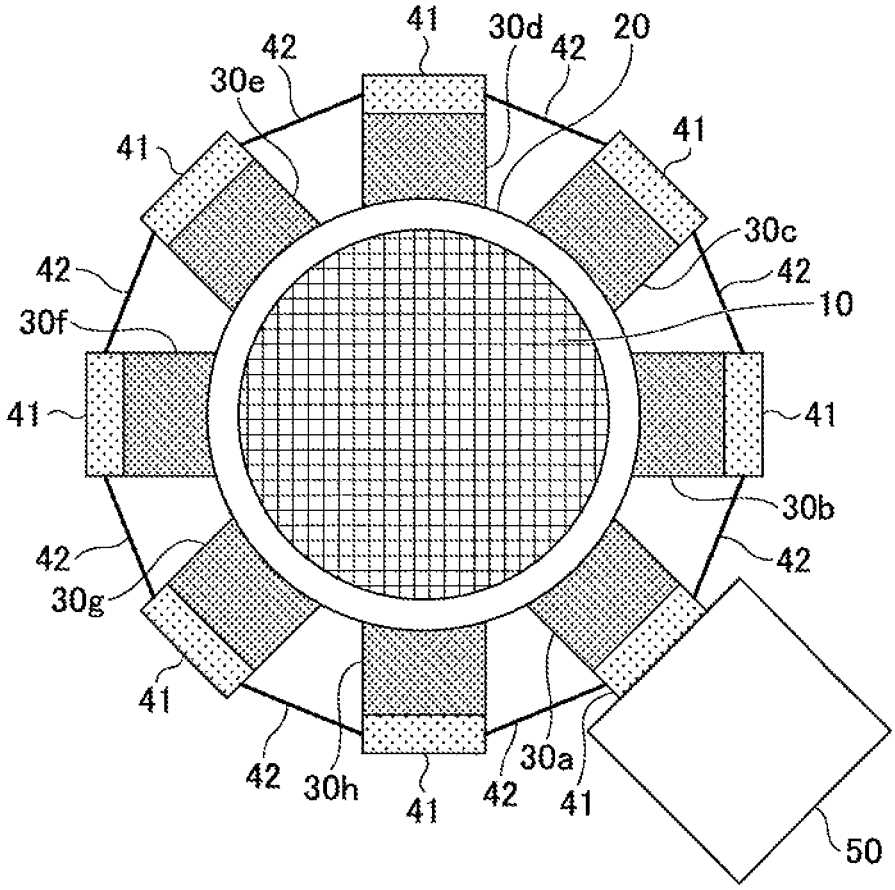
Figure 2:
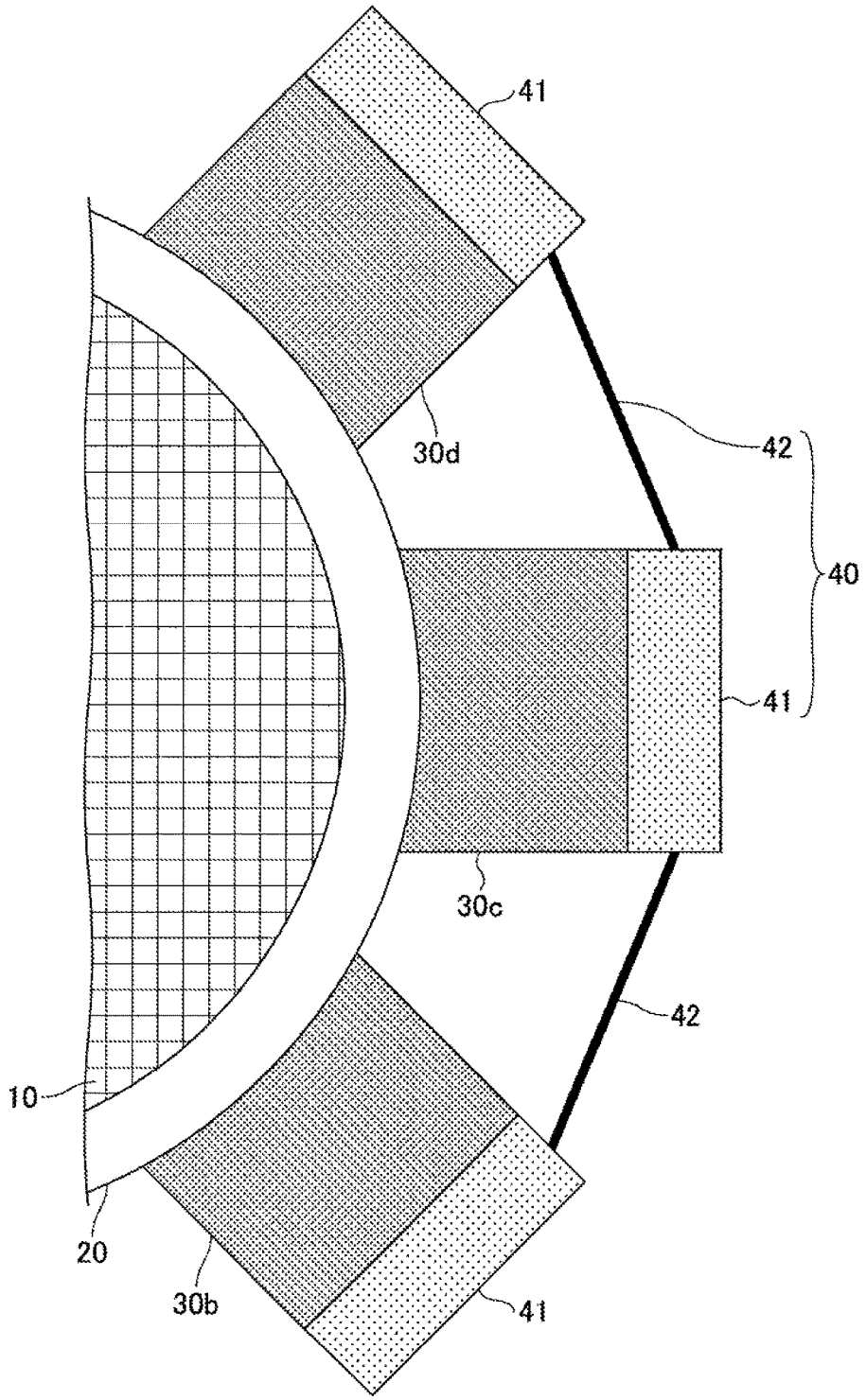
FIG. 2 is an enlarged view of part of the structure of the microwave applicator according to the first embodiment.

A microwave applicator according to a first embodiment is described with reference to FIGS. 1A and 1B. FIG. 1A is a cross-sectional view of a microwave applicator according to this embodiment. FIG. 1B is a cross-sectional view of the microwave applicator, taken along the one-dot chain line 1A-1B of FIG. 1A. The microwave applicator of this embodiment includes a housing 20 and waveguide resonators 30*a* through 30*h*. The housing 20 is formed of a material such as metal, and contains an object of heating 10. The waveguide resonators 30*a* through 30*h* are provided on and around the periphery of the housing 20. Each of the waveguide resonators 30*a* through 30*h* serves as a microwave resonator. The waveguide resonators 30*a* through 30*h* are connected by microwave waveguides 41 and microwave coaxial tubes 42. Furthermore, one of the microwave waveguides 41 is connected to a microwave generator 50.

According to this embodiment, the microwave waveguides 41 and the microwave coaxial tubes 42 define a microwave conductor 40 that propagates microwaves.

Specifically, the housing 20 and one of the microwave waveguides 41 are connected to opposite sides of each of the waveguide resonators 30*a* through 30*h*, and the microwave waveguides 41 are interconnected by the microwave coaxial tubes 42. Microwaves generated in the microwave generator 50 propagate through the microwave waveguides 41 and the microwave coaxial tubes 42 to be supplied to the waveguide resonators 30*a* through 30*h*.

The waveguide resonators 30*a* through 30*h* are so formed as to be different from one another in the resonant frequency at which microwaves resonate. The microwave generator 50 may be controlled by a controller 60 (FIG. 5B) to vary the frequency of generated microwaves to generate microwaves of the resonant frequencies of the waveguide resonators 30*a* through 30*h*.

Figure 3:
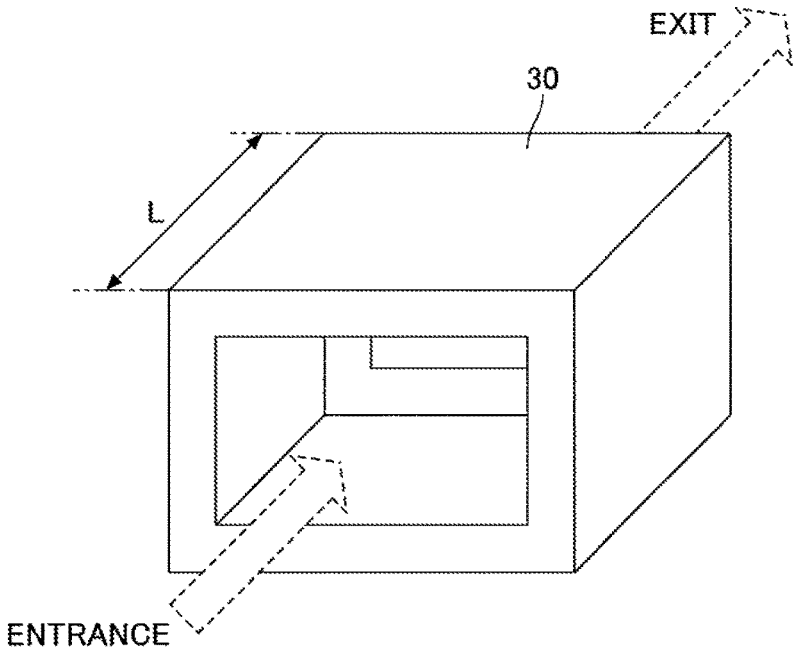
FIG. 3 is a diagram illustrating a structure of a waveguide resonator.

For example, as typified by a waveguide resonator 30 depicted in FIG. 3, the waveguide resonators 30*a* through 30*h* are hollow and have a rectangular tubular shape. The waveguide resonator 30 has openings at opposite ends, which serve as an entrance and an exit. The end openings are slightly narrower than the internal cavity of the waveguide resonator 30 to allow microwaves to reflect back and forth between the cavity's walls at the entrance and the exit. Thereby, the waveguide resonator 30 serves as a microwave resonator. The resonant frequency of the waveguide resonator 30 may be changed by changing the length L of the waveguide resonator 30.

The exit of each of the waveguide resonators 30*a* through 30*h* is connected to the housing 20. The entrance of each of the waveguide resonators 30*a* through 30*h* is connected to one of the microwave waveguides 41. Microwaves that have resonated in the waveguide resonators 30*a* through 30*h* at their respective resonant frequencies are radiated toward and heat the object of heating 10 provided in the housing 20.

According to this embodiment, a radiation thermometer 70 (FIG. 5B) that measures the temperature distribution of the object of heating 10 may be provided. The temperature distribution of the object of heating 10 may be measured with the radiation thermometer 70, and the microwave generator 50 may be controlled by the controller 60 to generate microwaves of such a frequency as to increase the intensity of microwaves for a low temperature portion of the object of heating 10 based on the measured temperature distribution.

According to the microwave applicator of this embodiment, the resonant frequency may differ among all of the waveguide resonators 30*a* through 30*h*, or may be the same in some and differ between some and others of the waveguide resonators 30*a* through 30*h*.

The microwave generator 50 may vary the frequency of generated microwaves. Therefore, a semiconductor device, more specifically, a high electron mobility transistor (HEMT) using nitride semiconductors, is used for the microwave generator 50.

Figure 4:
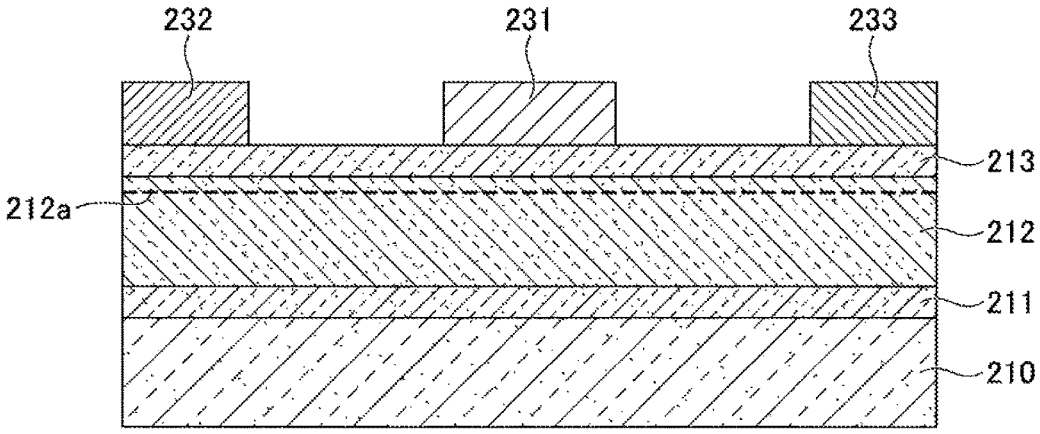
FIG. 4 is a diagram depicting a structure of a semiconductor device used in a microwave generator.

Referring to FIG. 4, an HEMT using nitride semiconductors is formed by stacking nitride semiconductor layers on a substrate 210 of, for example, Si or SiC. That is, a nucleation layer 211 formed of AlN, an electron transport layer 212, and an electron supply layer 213 are stacked in order on the substrate 210. The electron transport layer 212 is formed of GaN. The electron supply layer 213 is formed of AlGaN or InAlN. Thus, two-dimensional electron gas (2DEG) 212*a* is generated near the interface with the electron supply layer 213 in the electron transport layer 212. A gate electrode 231, a source electrode 232, and a drain electrode 233 are formed on the electron supply layer 213.

According to the microwave applicator of this embodiment, the microwave generator 50 varies the frequency of generated microwaves. The microwaves thus generated with a varied frequency in the microwave generator 50 resonate in one of the waveguide resonators 30*a* through 30*h*, and the microwaves that have resonated are radiated into the housing 20. Changing the frequency of microwaves changes the waveguide resonator in which the microwaves resonate. The microwaves of the resonant frequencies of the waveguide resonators 30*a* through 30*h* are radiated into the housing 20 from the waveguide resonators 30*a* through 30*h* in which the microwaves have resonated. As a result, the object of heating 10 provided in the housing 20 is uniformly heated.

Figure 5A:
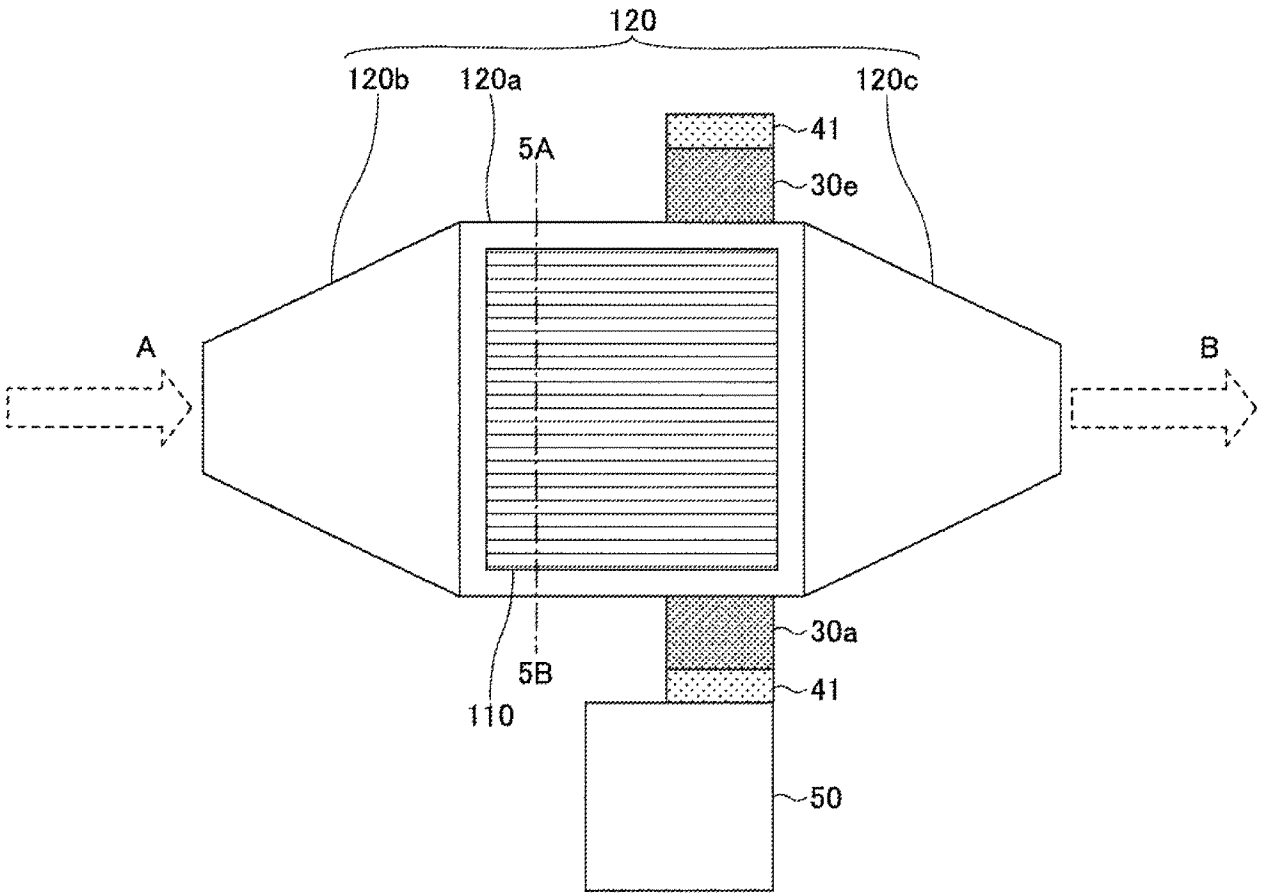
FIGS. 5A and 5B are diagrams depicting a structure of an exhaust gas purifier according to the first embodiment.
Figure 5B:
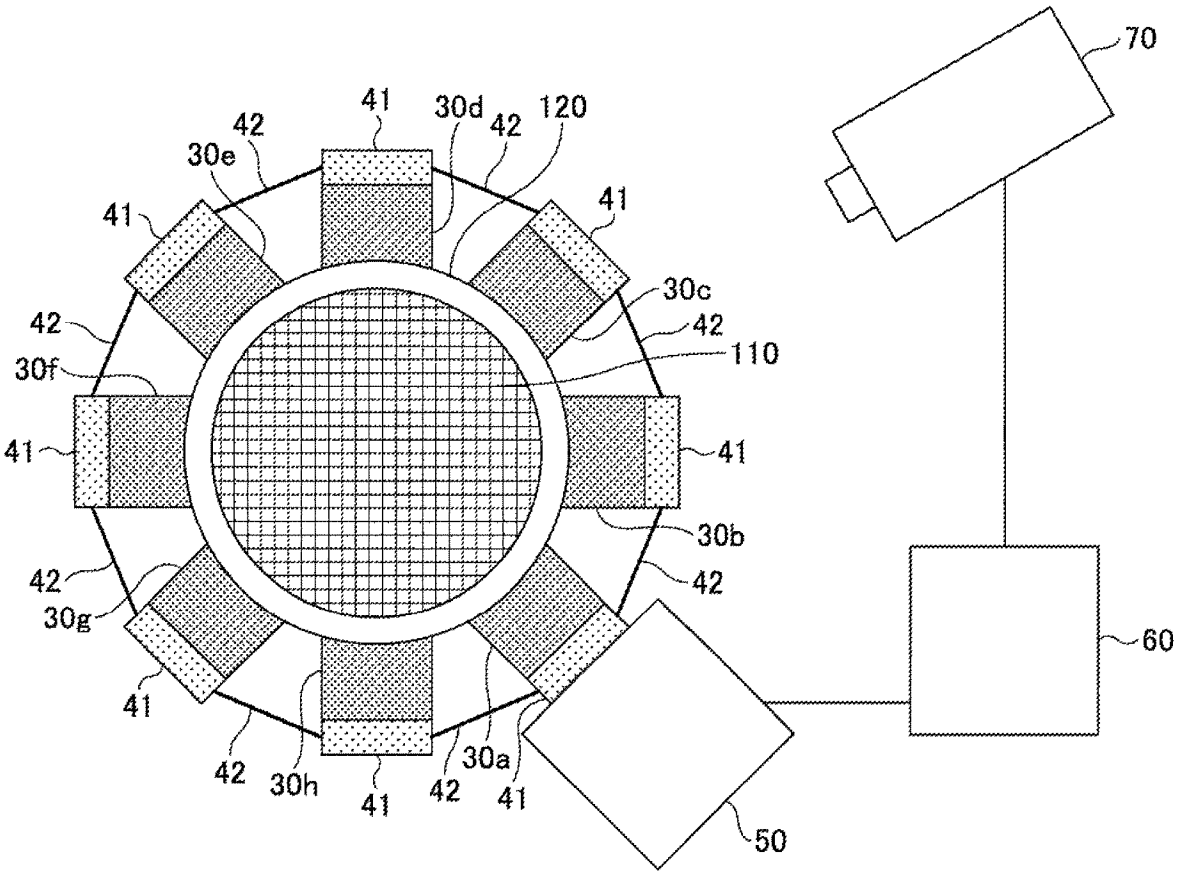

Next, an exhaust gas purifier according to the first embodiment is described with reference to FIGS. 5A and 5B. FIG. 5A is a cross-sectional view of an exhaust gas purifier according to this embodiment, taken along a direction in which exhaust gas flows. FIG. 5B is a cross-sectional view of the exhaust gas purifier, taken along the one-dot chain line 5A-5B in FIG. 5A.

The exhaust gas purifier of this embodiment includes the microwave applicator of this embodiment that applies microwaves to an object of heating. That is, the exhaust gas purifier of this embodiment includes a particulate capturing part 110, which is an object of heating, a housing 120, the waveguide resonators 30*a* through 30*h*, the microwave waveguides 41, the microwave coaxial tubes 42, the microwave generator 50, the controller 60, and the radiation thermometer 70. The waveguide resonators 30*a* through 30*h* are provided around a cylindrical portion of the housing 120 to radiate microwaves that have resonated in the waveguide resonators 30*a* through 30*h* toward the particulate capturing part 110 provided in the housing 120. The waveguide resonators 30*a* through 30*h* are preferably provided on the downstream side in the direction of the flow of exhaust gas in the exhaust gas purifier.

The particulate capturing part 110, which captures particulates such as PM contained in exhaust gas, is formed of, for example, a DPF. The DPF is formed of, for example, a honeycomb structure whose adjacent gas passage openings are alternately closed at each end to cause exhaust gas entering a gas passage through its entrance opening to exit from the exit opening of a gas passage different from the gas passage the exhaust gas has entered.

The housing 120 is formed of a metal material such as stainless steel. The housing 120 includes a housing body 120*a* that covers the periphery of the particulate capturing part 110, and an inlet port 120*b* and an outlet port 120*c* connected to the housing body 120*a*. According to the exhaust gas purifier of this embodiment, exhaust gas discharged from, for example, an engine flows in the direction indicated by the dashed arrow A to enter the housing 120 through the inlet port 120*b*, and passes through the particulate capturing part 110 provided in the housing body 120*a* to be purified. Thereafter, the exhaust gas purified in the particulate capturing part 110 exits from the outlet port 120*c* in the direction indicated by the dashed arrow B.

According to the exhaust gas purifier of this embodiment, the microwave generator 50 varies the frequency of generated microwaves. The microwaves thus generated with a varied frequency in the microwave generator 50 resonate in one of the waveguide resonators 30*a* through 30*h*, and the microwaves that have resonated are radiated into the housing 120. Changing the frequency of microwaves changes the waveguide resonator in which the microwaves resonate. The microwaves of the resonant frequencies of the waveguide resonators 30*a* through 30*h* are radiated into the housing 120 from the waveguide resonators 30*a* through 30*h* in which the microwaves have resonated. As a result, the particulate capturing part 110 provided in the housing 120 is uniformly heated.

The radiation thermometer 70, which is an example of a measurement device configured to measure the temperature of an object of heating, may measure the temperature of the particulate capturing part 110 region by region. The radiation thermometer 70 is connected to the controller 60. The controller 60 may control the frequency of microwaves generated in the microwave generator 50 based on information on the temperature distribution measured in the radiation thermometer 70. Instead of employing the radiation thermometer 70, multiple thermocouples may be buried in the particulate capturing part 110 as a measurement device to measure the temperatures of regions of the particulate capturing part 110.

Figure 6:
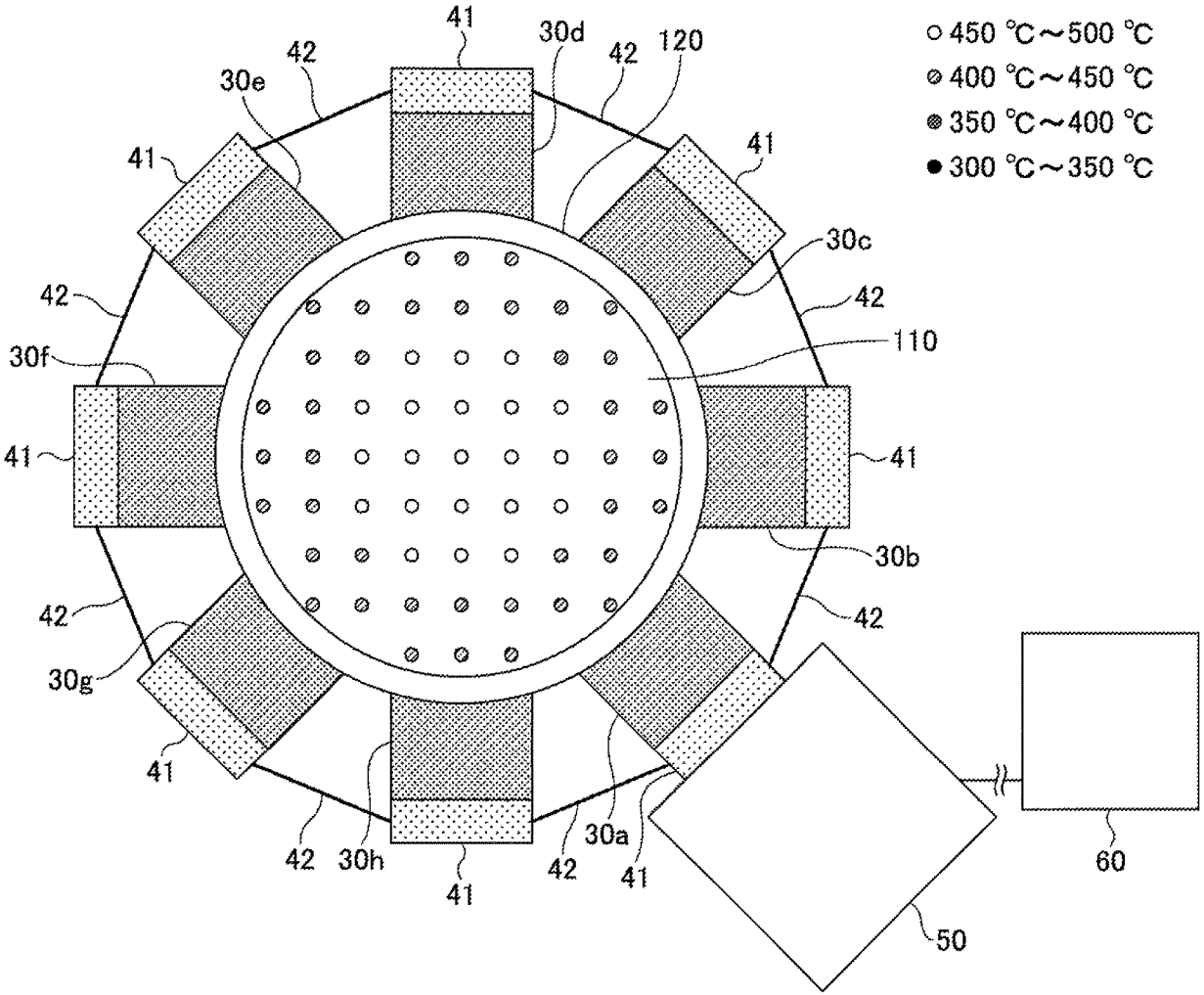
FIG. 6 is a diagram illustrating a temperature distribution in the exhaust gas purifier.

Next, the results of simulating a distribution of maximum temperatures at the time of heating the particulate capturing part 110 are described. FIG. 6 illustrates a distribution of maximum temperatures in the particulate capturing part 110 in the case of generating microwaves while varying their frequency in the microwave generator 50 according to the exhaust gas purifier of this embodiment. The resonant frequency is 2.42 GHz in the waveguide resonator 30*a*, 2.43 GHz in the waveguide resonator 30*b*, 2.44 GHz in the waveguide resonator 30*c*, 2.45 GHz in the waveguide resonator 30*d*, 2.46 GHz in the waveguide resonator 30*e*, 2.47 GHz in the waveguide resonator 30*f*, 2.48 GHz in the waveguide resonator 30*g*, and 2.49 GHz in the waveguide resonator 30*h*. Therefore, the microwave generator 50 varies the frequency of microwaves within the range of 2.42 GHz to 2.49 GHz.

Figure 7:
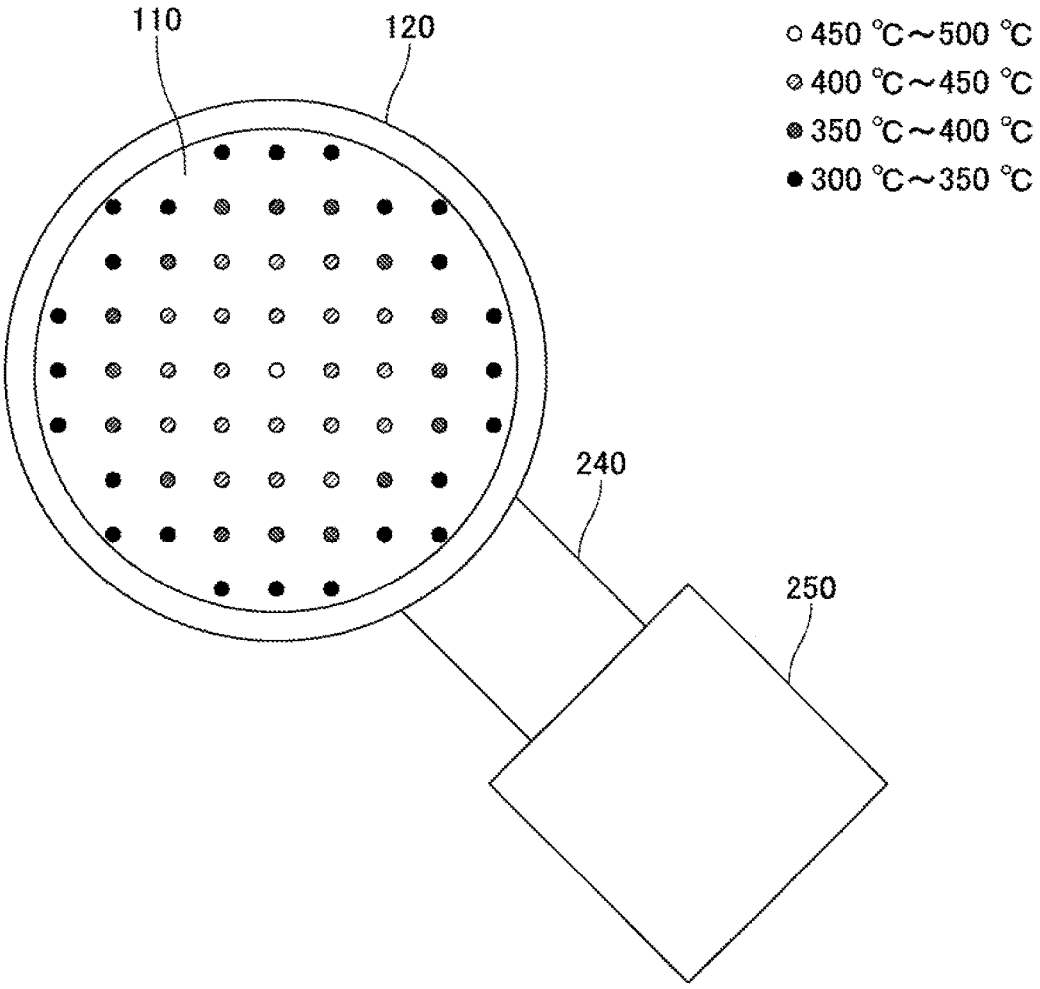
FIG. 7 is a diagram illustrating a temperature distribution in another exhaust gas purifier.

FIG. 7 illustrates a distribution of maximum temperatures in the particulate capturing part 110 in the case of generating microwaves of a single frequency in a microwave generator. Specifically, the exhaust gas purifier depicted in FIG. 7 includes the particulate capturing part 110, which is an object of heating, the housing 120, a microwave conductor 240, and a microwave generator 250. The housing 120 and the microwave generator 250 are connected by the microwave conductor 240. Microwaves of 2.45 GHz generated in the microwave generator 250 are emitted to the particulate capturing part 110 provided in the housing 120 through the microwave conductor 240.

As illustrated in FIG. 6, according to the exhaust gas purifier of this embodiment, the maximum temperatures at the time of heating the particulate capturing part 110 range from 400° C. to 500° C., and the entirety of the particulate capturing part 110 is substantially uniformly heated. Furthermore, the temperature of a peripheral portion of the particulate capturing part 110 near the housing 120 is higher than or equal to 400° C. Accordingly, it is possible to burn and remove deposited particulates such as PM substantially uniformly in both the center and the peripheral portion of the particulate capturing part 110. Therefore, it is possible to completely or nearly completely regenerate the particulate capturing part 110 with substantially no particulates such as PM remaining.

In contract, as illustrated in FIG. 7, in the case of emitting microwaves of a single frequency, the temperature of the particulate capturing part 110 is lower in a peripheral portion near the housing 120, where the temperature is lower than or equal to 350° C., than in the center, where the temperature is 400° C. to 500° C. Therefore, in the particulate capturing part 110, it is possible to burn and remove deposited particulates such as PM in the high-temperature center, while deposited particulates such as PM are not sufficiently burned and removed in the low-temperature peripheral portion. Therefore, the regeneration of the particulate capturing part 110 is incomplete.

Thus, according to the microwave applicator of this embodiment, it is possible to substantially uniformly heat the particulate capturing part 110, which is an object of heating.

[b]Second Embodiment

Next, a heater according to a second embodiment is described. A heater according to this embodiment includes a microwave applicator similar to the microwave applicator of the first embodiment, and is used to heat, for example, food.

Figure 8:
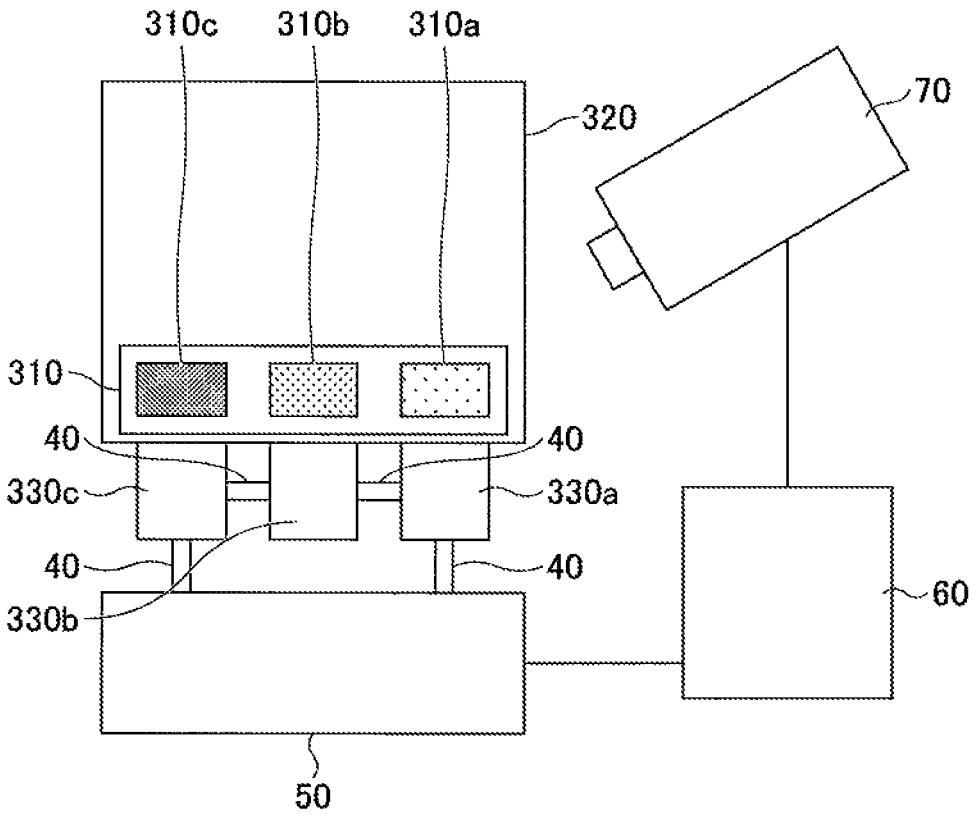
FIG. 8 is a diagram depicting a structure of a heater according to a second embodiment.

FIG. 8 is a diagram depicting a structure of the heater of this embodiment. Referring to FIG. 8, the heater of this embodiment includes a housing 320 and waveguide resonators 330*a* through 330*c*. The housing 320 is formed of a material such as metal. An object of heating 310 is placed in the housing 320. The waveguide resonators 330*a* through 330*c* are provided on and around the periphery of the housing 320. The waveguide resonators 330*a* through 330*c* are interconnected and also connected to the microwave generator 50 by the microwave conductor 40.

The waveguide resonators 330*a* through 330*c* are so formed as to be different from one another in the resonant frequency at which microwaves resonate. Specifically, the resonant frequency is a frequency f1 in the waveguide resonator 330*a*, a frequency f2in the waveguide resonator 330*b*, and a frequency f3in the waveguide resonator 330*c*. The frequencies f1, f2 and f3 are different from one another.

The microwave generator 50 may be controlled by the controller 60 to vary the frequency of generated microwaves. For example, it is assumed that the object of heating 310 is a box lunch that contains rice 310*a*, meat 310*b*, and vegetables 310*c*. According to this embodiment, in the box lunch, the rice 310*a* and the meat 310*b* are to be heated while the vegetables 310*c* are not to be heated. The box lunch is placed in the housing 320 so that the rice 310*a* is positioned over the waveguide resonator 330*a*, the meat 310*b* is positioned over the waveguide resonator 330*b*, and the vegetables 310*c* are positioned over the waveguide resonator 330*c*.

Thereafter, the microwave generator 50 generates the frequency f1. The frequency f1 is the resonant frequency of the waveguide resonator 330*a*. Therefore, microwaves of the frequency f1 resonate in the waveguide resonator 330*a* to be emitted to the rice 310*a* of the box lunch. Because the frequency f1 is neither the resonant frequency of the waveguide resonator 330*b* nor the resonant frequency of the waveguide resonator 330*c*, microwaves are scarcely emitted from the waveguide resonators 330*b* and 330*c*. Accordingly, it is possible to heat the rice 310*a* alone in the box lunch.

Next, the microwave generator 50 generates the frequency f2. The frequency f2 is the resonant frequency of the waveguide resonator 330*b*.

Therefore, microwaves of the frequency f2 resonate in the waveguide resonator 330*b* to be emitted to the meat 310*b* of the box lunch. Because the frequency f2 is neither the resonant frequency of the waveguide resonator 330*a* nor the resonant frequency of the waveguide resonator 330*c*, microwaves are scarcely emitted from the waveguide resonators 330*a*and 330*c*. Accordingly, it is possible to heat the meat 310*b* alone in the box lunch.

Thus, it is possible to heat the rice 310*a* and the meat 310*b* while not heating the vegetables 310*c* in the box lunch, which is the object of heating 310. Furthermore, according to this embodiment, the microwave generator 50 may be controlled by the controller 60 to vary the frequency of generated microwaves while measuring the temperature of the object of heating 310 with the radiation thermometer 70.

In other respects than those described above, the second embodiment may be the same as the first embodiment.

[c]Third Embodiment

Next, a chemical reactor according to a third embodiment is described. A chemical reactor according to this embodiment includes the microwave applicator of the first embodiment.

Figure 9:
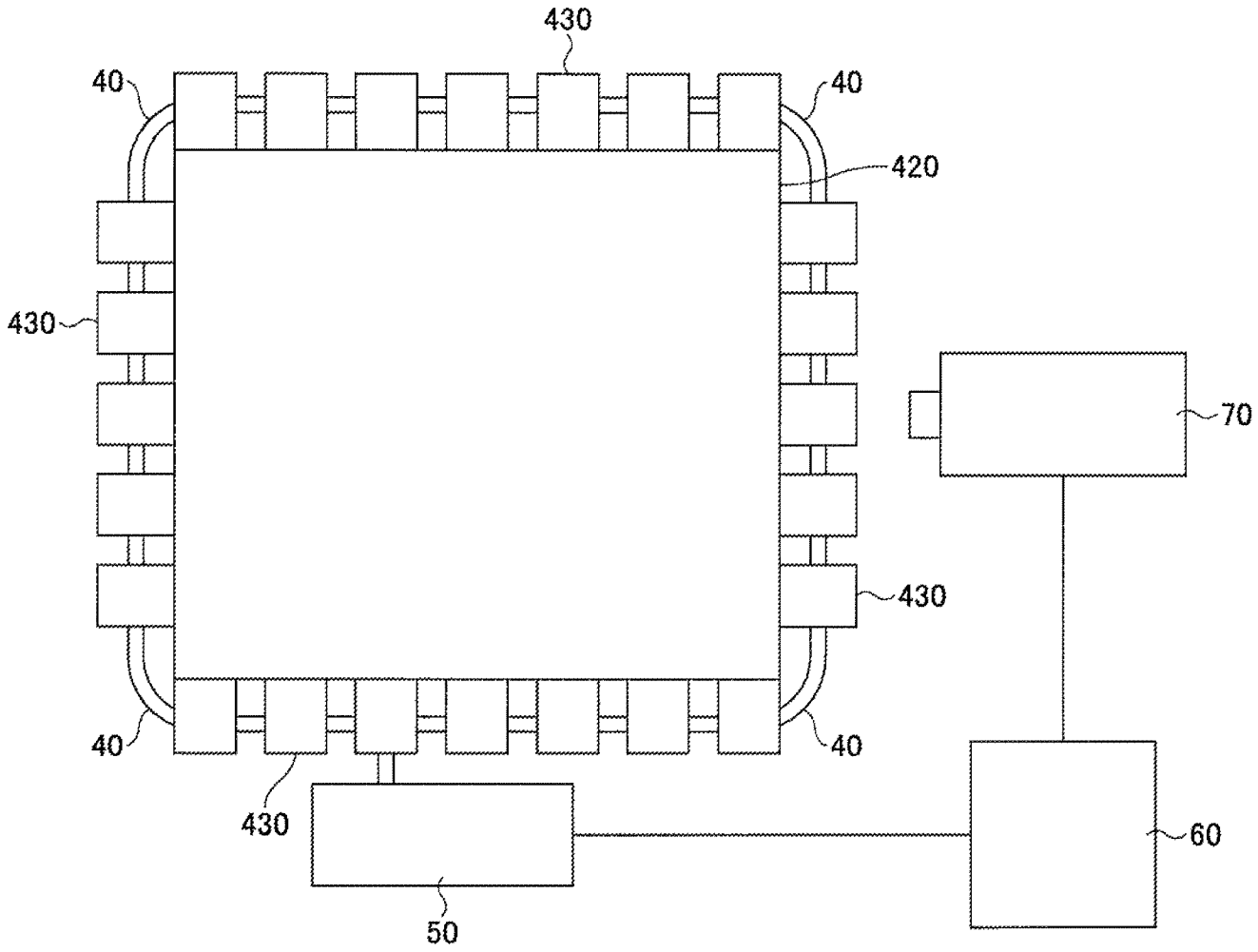
FIG. 9 is a diagram depicting a structure of a chemical reactor according to a third embodiment.

FIG. 9 is a diagram depicting a structure of the chemical reactor of this embodiment. Referring to FIG. 9, the chemical reactor of this embodiment includes a housing 420 and waveguide resonators 430. The housing 420 is formed of a material such as metal, and configured to contain an object of heating (not depicted). The waveguide resonators 430 are provided on and around the periphery of the housing 420. The waveguide resonators 430 are interconnected and also connected to the microwave generator 50 by the microwave conductor 40.

The waveguide resonators 430 are so formed as to be different from one another in the resonant frequency at which microwaves resonate. According to this embodiment, an internal temperature distribution of the housing 420 is measured with the radiation thermometer 70, and the microwave generator 50 is controlled by the controller 60 to generate microwaves of such a frequency as to increase the intensity of microwaves for a low temperature region inside the housing 420 based on the measured temperature distribution.

According to this embodiment, when a property of the object of heating, such as color, is subject to change depending on the condition of heating or temperature, a device for detecting electromagnetic waves such as light, for example, a light-receiving element or an image capturing device, may be employed as a measurement device along with or in lieu of the radiation thermometer 70.

In other respects than those described above, the third embodiment may be the same as the first embodiment.

According to a microwave applicator of an embodiment, it is possible to uniformly heat an object of heating.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A microwave applicator, comprising:

a housing configured to contain an object of heating;

a plurality of microwave resonators provided on and around a periphery of the housing;

a microwave conductor interconnecting the plurality of microwave resonators; and a microwave generator configured to generate microwaves of different frequencies, wherein each of the plurality of microwave resonators includes a first opening at a first end and a second opening at a second end opposite to the first end and each of the plurality of microwave resonators is configured to resonate the generated microwaves of a resonant frequency of said each of the plurality of microwave resonators by reflecting the generated microwaves back and forth between the first end and the second end, and to emit the resonated microwaves to the object of heating contained in the housing, and the emitted resonant frequency of a first microwave resonator among the plurality of microwave resonators is different from the emitted resonant frequency of a second microwave resonator among the plurality of microwave resonators.

2. The microwave applicator as claimed in claim 1, further comprising:

a controller configured to control the frequencies of the microwaves generated in the microwave generator; and a measurement device configured to measure a temperature of the object of heating, wherein the controller is configured to control the microwave generator to generate the microwaves of such a frequency as to increase an intensity of the microwaves for a first portion of the object of heating where the temperature is lower than in a second portion of the object of heating, based on the temperature of the object of heating measured by the measurement device.

3. The microwave applicator as claimed in claim 2, wherein the measurement device is a thermometer.

4. The microwave applicator as claimed in claim 2, wherein the measurement device is a device configured to detect electromagnetic waves.

5. The microwave applicator as claimed in claim 1, wherein the microwave generator includes a semiconductor device including a nitride semiconductor.

6. The microwave applicator as claimed in claim 1, wherein all of resonant frequencies of the plurality of microwave resonators are different.

7. The microwave applicator as claimed in claim 1, wherein the plurality of microwave resonators are a plurality of waveguide resonators.

8. An exhaust gas purifier, comprising:

the microwave applicator as set forth in claim 1;

wherein the object of heating is a particulate capturing part configured to capture particulates contained in exhaust gas, wherein the housing includes a housing body covering the particulate capturing part; and an inlet port and an outlet port for the exhaust gas, connected to the housing body, and wherein the microwave applicator is configured to apply the microwaves to the particulate capturing part.

9. A heater, comprising:

the microwave applicator as set forth in claim 1, wherein the microwave applicator is configured to apply the microwaves to the object of heating to heat the object of heating.

10. A chemical reactor, comprising:

the microwave applicator as set forth in claim 1, wherein the microwave applicator is configured to apply the microwaves to the object of heating to heat the object of heating.

* * * * *